US012350727B2

(12) United States Patent
Gerrits

(10) Patent No.: US 12,350,727 B2
(45) Date of Patent: Jul. 8, 2025

(54) SYSTEM AND METHODS FOR PRODUCING A DEEP DRAWN CUP

(71) Applicant: D&H INDUSTRIES, Oconomowoc, WI (US)

(72) Inventor: Samuel J. Gerrits, Pewaukee, WI (US)

(73) Assignee: D&H INDUSTRIES, Oconomowoc, WI (US)

( * ) Notice: Subject to any disclaimer, the term of this patent is extended or adjusted under 35 U.S.C. 154(b) by 437 days.

(21) Appl. No.: 17/922,243

(22) PCT Filed: Apr. 29, 2021

(86) PCT No.: PCT/US2021/029970

§ 371 (c)(1),
(2) Date: Oct. 28, 2022

(87) PCT Pub. No.: WO2021/222626

PCT Pub. Date: Nov. 4, 2021

(65) Prior Publication Data

US 2023/0182192 A1 Jun. 15, 2023

Related U.S. Application Data

(60) Provisional application No. 63/017,600, filed on Apr. 29, 2020.

(51) Int. Cl.
*B21D 22/28* (2006.01)
*B21D 51/26* (2006.01)

(52) U.S. Cl.
CPC ..... *B21D 22/28* (2013.01); *B21D 51/2615* (2013.01)

(58) Field of Classification Search
USPC ..... 72/347, 348, 349, 350
See application file for complete search history.

(56) References Cited

U.S. PATENT DOCUMENTS 1,054,669 A * 3/1913 Bowen ..... B21D 22/28 184/14.1
1,295,430 A * 2/1919 Carlson ..... B21D 45/06 72/344
3,848,449 A * 11/1974 Campion ..... B21C 3/16 413/1
3,945,231 A * 3/1976 Imazu ..... B21D 22/28 413/1
4,193,279 A * 3/1980 Maeder ..... B21D 22/283 72/344
5,048,317 A * 9/1991 Hirota ..... B21D 51/2646 72/347
2006/0266092 A1* 11/2006 Kawai ..... B21D 22/28 72/349

(Continued)

OTHER PUBLICATIONS

Campion, David. "Deep Drawing and Ironing: Theory and Practice.—I." Sheet Metal Ind. 57, No. 2 (1980): 111-119.

(Continued)

*Primary Examiner* — Bobby Yeonjin Kim
*Assistant Examiner* — P Derek Pressley
(74) *Attorney, Agent, or Firm* — MARSHALL, GERSTEIN & BORUN LLP

(57) ABSTRACT

An apparatus for forming a deep drawn cup can include a double die that is adapted to form a cup shape and iron a wall thickness of the drawn cup in a single operation.

18 Claims, 13 Drawing Sheets

(56) References Cited

U.S. PATENT DOCUMENTS

2015/0343516 A1* 12/2015 Schremmer ..... B21D 51/2669
72/349

OTHER PUBLICATIONS

International Search Report and Written Opinion for corresponding International Application No. PCT/US2021/029970, mailing date Oct. 7, 2021.
"Part 5—Deep Drawing (and 'pressing')," Sheet Metal Industries, No. 75/76 (Jun. 1, 1975), pp. 86-105.
Narayanasamy, R., and C. Loganathan. "Some studies on wrinkling limit of commercially pure aluminium sheet metals of different grades when drawn through Conical and Tractrix dies." International Journal of Mechanics and Materials in Design 3 (2006): 129-144.

* cited by examiner

SYSTEM AND METHODS FOR PRODUCING A DEEP DRAWN CUP

CROSS REFERENCE TO RELATED APPLICATIONS

This application is the U.S. National phase of International Patent Application No. PCT/US21/029970 filed Apr. 29, 2021, which in turn claims the priority benefit of U.S. Provisional Application 63/017,600 filed on Apr. 29, 2020, the respective disclosures of which are hereby incorporated by reference in their entireties.

FIELD OF THE DISCLOSURE

The present disclosure generally relates to systems and methods for forming metal cups through a deep draw operation and, in particular, to implementing a double die designed to form a metal blank into the desired cup shape while ironing the sidewalls in a single drawing operation.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Drawing refers to a specific technique of metal forming which implements a punch to force a flat precut metal blank into a die cavity of a press-mounted die. As the metal blank is pushed into the die cavity, it begins to take the shape of the cavity. Drawing may not be an ideal technique for thick and/or rigid metals as the end result may not achieve a desired uniform thickness or may have micro-cracks throughout.

Deep drawn cups are utilized in forming a variety of products, such as pressure vessels. When forming pressure vessels, material quality and uniformity in the thickness of the material after drawing are important factors for avoiding failure of the pressure vessels during use. Defects in the materials or thinner regions of a pressure vessel wall could result in a point of failure after pressurization. Conventional drawing methods have been limited in the types and grades, typically high grades, of metals that can be utilized as the drawing process can induce microcracking or other potential defects into lower grades of metals.

Conventionally, deep drawing is used to form two components of the pressure vessel that are joined by welding. To prepare the deep drawn cups for welding, the tops are typically machined down to provide a flat smooth welding surface. Machining processes, however, can introduce some defects into the cups.

SUMMARY

As described further herein, the disclosure generally relates to apparatus, systems, and methods. This summary is not comprehensive and is necessarily limited to certain aspects of the invention described herein. Additional or alternative components, aspects, functions, or actions may be included in various embodiments, as described further below.

An apparatus for deep drawing a metal blank into a deep drawn cup having a cup sidewall thickness $T_{FC}$, a cup inner diameter $D_{FC}$, and a cup height $H_{FC}$, the apparatus can include a top die comprising a bore opening having a tractrix profile region and a first draw line downstream of the tractrix profile region as viewed from a first end of the opening to a downstream second end of the opening, wherein the tractrix profile region has a tractrix curvature configured based on the outer diameter of the metal blank and outer diameter of the to be formed cup; a bottom die positioned immediately downstream of the top die and spaced a predetermined distance from the top die. The bottom die can include a draw die having a bore opening having a second draw line, wherein a second draw line diameter $D_{DL2}$ is smaller than a first draw line diameter $D_{DL1}$, and a die holder into which the draw die is press fit, the draw die holder having a bottom surface having a profile substantially the same as a profile of a bottom of the cup to be formed. The apparatus can further include a punch for applying a pressure to the metal blank to draw the metal blank into the top and bottom dies, wherein when the punch applies a pressure to the metal blank, the metal blank is drawn into the bore opening of the top die along the tractrix profile region and the first draw line to produce an intermediate cup, and then the intermediate cup is further drawn into the bore opening of the draw die and deformed along the second draw line thereby forming the deep drawn cup, wherein a first ironing of a sidewall thickness occurs as the metal blank is drawn through the first draw line and a second ironing of a sidewall thickness occurs as the intermediate cup is drawn through the second draw line. A ratio of a diameter of the punch to a diameter of the metal blank ($P_D$:$C_D$) is about 0.28 to about 0.64. The predetermined distance is measured as a distance between an upstream-most edge of a length of the first draw line and an upstream-most edge of a length of the second draw line. The predetermined distance is about 59% to about 78% of a theoretical height of the intermediate cup $H_c$.

A method of deep drawing a metal blank into a deep drawn cup having a cup wall thickness $T_{FC}$, a cup inner diameter $D_{FC}$ and a cup height $H_{FC}$ cup, can include applying pressure to a metal blank using a punch to deform the metal blank drawing it into a bore opening of a top die, the bore opening having a tractrix profile region and a first draw line downstream of the tractrix profile region as viewed from a first end of the opening to a downstream second end of the opening, wherein the tractrix profile is configured based on the outer diameter of the metal blank and outer diameter of the to be formed cup, wherein upon drawing the metal blank through the bore opening of the top die the metal blank is drawn into a desired cup shape and a sidewall thickness is ironed to a first reduced thickness, and applying further pressure to the metal blank with the punch to further deform the metal blank drawing it into a bore opening of a bottom die positioned immediately downstream of the top die and spaced a predetermined distance from the top die, wherein the bore opening of the bottom die has a second draw line, a second draw line diameter $D_{DL2}$ being smaller than a first draw line diameter $D_{DL1}$, thereby further ironing the sidewall thickness to a second side wall thickness. A ratio of a diameter of the punch to a diameter of the metal blank ($P_D$:$C_D$) is about 0.28 to about 0.64. The predetermined distance is measured as a distance between an upstream-most edge of a length of the first draw line and an upstream-most edge of a length of the second draw line. The predetermined distance is about 59% to about 78% of a theoretical height of the intermediate cup $H_{IC}$ of the deep drawn cup.

In any of the apparatus or methods herein, a diameter of the punch can be substantially same as the cup inner diameter $D_{FC}$.

In any of the apparatus or methods herein, the first draw line diameter $D_{DL1}$ can be determined by $D_{DL1}=P_D+2(0.85T_{TC})$, where $P_D$ is a diameter of the punch and $T_{TC}$ is a theoretical maximum thickness of a sidewall of a forming cup exiting the tractrix profile region.

In any of the apparatus or methods herein, the first draw line length $L_{DL1}$ can be determined by $L_{DL1}=1.2*T_{TC}$, where $T_{TC}$ is a theoretical maximum thickness of a sidewall of a forming cup exiting the tractrix profile region.

In any of the apparatus or methods herein, $T_{TC}$ can be 1.22 times a thickness of the metal blank.

In any of the apparatus or methods herein, the second draw line diameter $D_{DL2}$ can be determined by $D_{DL2}=P_D+(2T_{FC})$, where $P_D$ is a diameter of the punch and $T_{FC}$ is the sidewall thickness of the cup.

In any of the apparatus or methods herein, the second draw line length $L_{DL2}$ can be determined by $L_{DL2}=1.4*T_{IC}$, where $T_{IC}$ is a thickness of the intermediate cup.

In any of the apparatus or methods herein, $T_{IC}$ can be 85% of a theoretical maximum thickness of a sidewall of a forming cup exiting the tractrix profile region $T_{TC}$.

In any of the apparatus or methods herein, the first draw line irons a thickness of the forming cup about 15% to about 33%.

A method of forming an apparatus for deep drawing a cup, the apparatus comprising a top die spaced a predetermined distance from a bottom die, the method can include preparing a top die having a bore opening having a tractrix profile region and a first draw line. The tractrix profile is determined by determining points along a tractrix curve by articulating a segment having the target cup height in about 10° increments from a vertical segment representing the target cup height to a horizontal segment perpendicular to the vertical segment, and projecting the points along the curve to a space below the curve at equivalent distances to develop an inverted tractrix curve defining the tractrix profile. The first draw line is determined by defining a diameter of the first draw line $D_{DL1}$ such that $D_{DL1}=P_D+2(0.85T_{TC})$, where $P_D$ is a diameter of the punch and $T_{TC}$ is a theoretical maximum thickness of a sidewall of a forming cup exiting the tractrix profile region, and defining a length of the first draw line $L_{DL1}$ such that $L_{DL1}=1.2*T_{TC}$, where $T_{TC}$ is a theoretical maximum thickness of a sidewall of a forming cup exiting the tractrix profile region. The method can further include preparing the bottom die having a draw die having a second draw line. The second draw line being determined by defining a diameter of the second draw line $D_{DL2}$ such that $D_{DL2}=P_D+(2T_{FC})$, where $P_D$ is a diameter of the punch and $T_{FC}$ is the sidewall thickness of the cup, and defining a length of the second draw line $L_{DL2}$ such that $L_{DL2}=1.4*T_{IC}$, where $T_{IC}$ is a thickness of an intermediate cup exiting the top die. The method can further include selecting the predetermined distance between the top and bottom die as measured between an upstream most edge of the first draw line length to an upstream most edge of the second draw line length to be 0.59% to about 78% of a theoretical height of the intermediate cup.

An apparatus for preparing an opening of a deep drawn cup for welding can include a base for receiving the deep drawn cup, the base having a receiving area having a shape substantially matching the shape of the deep drawn cup, wherein the base has one or more sidewalls surrounding the deep drawn cup when the deep drawn cup is placed in the receiving area, the one or more side walls having a height between 0 to 24% of the thickness of the sidewalls of the deep drawn cup remains extended above the sidewalls; and a smash die for applying pressure to a top edge of the deep drawn cup sufficient to flatten the top edge, wherein the smash die has a substantially planar die surface for engaging with the top edge of the cup and a width wider than a diameter of the cup.

BRIEF DESCRIPTION OF THE DRAWINGS

FIG. 1C is a schematic illustration of bore opening profiles of a top die and bottom die of an apparatus of the disclosure;

DETAILED DESCRIPTION

Figure 1A:
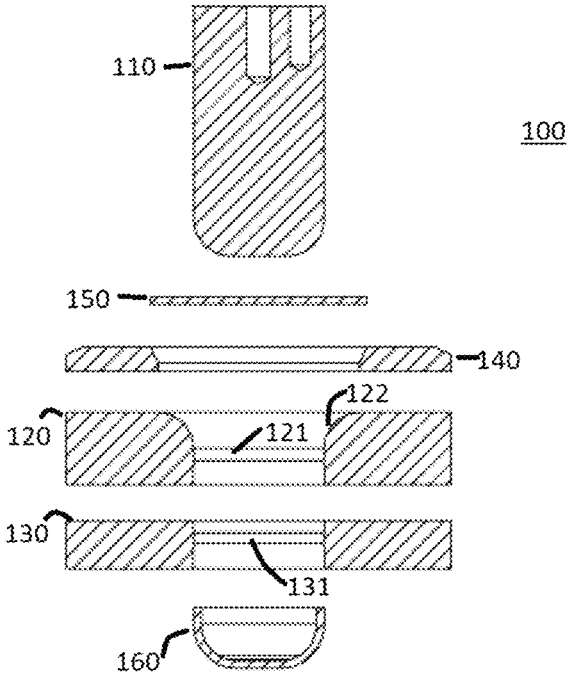
FIG. 1A illustrates a schematic view of a deep draw apparatus.

The apparatus and methods of the current disclosure implement techniques for producing a deep drawn cup using a double die configuration including a top die configured based on a tractrix curve. The die configuration can allow for an effective deep draw of high strength/low alloy materials and does not require custom materials to be able to obtain acceptable deep drawing results. The double die arrangement, including for example, the profiles of the bore openings of each die and spacing of the dies, has been found to improve the deep drawing operation and can product improved uniformity and reduced or eliminate defects in the drawn cups, even when using for example, high strength, low alloy materials. In particular, the double die allows for the shaping of the metal blank into the desired cup shape and ironing of the sidewall thickness in a single operation. This can be advantageous in avoiding overworking of the metal and with materials that strain harden when being worked and become brittle with increased working.

The draw operation of the current disclosure implements a double die to simultaneously thin the walls and shape the metal blank into a cup. By thinning and shaping the metal simultaneously, the current disclose avoids issues that can arise in the forming processes. During the drawing process, the sidewalls of the forming cup will thicken during the shaping processes. An ironing of these sidewalls is needed to achieve a uniform cup wall thickness. For conventional operations, this thinning of the walls in regions where thickening occurred is done after the drawing process, for example, by a secondary machining operation. However, this can induce defects or cause other material weakens, particularly in lower grade metals. For example, certain metals harden during the drawing process, making subsequent operations, such as thinning the walls more difficult and/or susceptible to inducing defects, such as microcracking, in the material. This is why conventional processes often require custom, high alloy metals for deep drawing operations that are specifically engineered to better handle the secondary machining process.

The apparatus and methods of the disclosure can be used with various high strength low alloy materials. For example, the metal blank can be a carbon steel with a carbon content of about 0.8 to about 0.15. For example, A1008 to A1015 steel can be used as the metal blank. The material of the metal blank can have a tensile strength up to 125,000 psi and/or an elongation of greater than 18%.

In the drawing operation of the current disclosure, cup shape formation and the ironing process are done in a single continuous drawing operation. As the punch begins to push the metal blank through the bore opening of the top die (also referred to herein as the tractrix die), the top die contours the metal blank while simultaneously thinning the material. Once the metal blank reaches a bottom die at the bottom of the top die, the material undergoes another thinning operation while also being forced into a cavity of the bottom die to form the cup shape. By thinning and shaping simultaneously throughout a single continuous drawing operation, the transformation will occur before the material hardens, which can reduce or eliminate potential defects in the cup material, while providing a more uniform cup thickness.

Once the cup is formed, a separate smash operation can be performed using an apparatus that has a base for receiving the cup and smash die that engages with a top lip of the cup to prepare the top lip of the cup for welding. The smashing operation and apparatus is described herein in greater detail below with respect to FIG. 3. The smash operation can be used to prepare the cup for subsequent welding such as for joining two cups for forming a pressure vessel. To obtain a strong weld, it can be advantageous to have smooth flat welding surfaces. The deep drawing operation can result in a cup with a tapered edge at the open-end of the cup, which may not be suitable or ideal for welding. The smash operation of the current disclosure can advantageously provide a flat top surface of the cup without otherwise deforming the sidewalls, inducing defects into the cup material, and/or fracturing the cup. To perform the smash operation, the cup may be placed in the base, where the cup protrudes from the base by a predefined amount, the smash die may then be pressed onto the base to compress the open-end of the cup. It has been found that the selection of the base dimensions and particularly the amount of cup exposed the base need to be controlled to achieve a flat top surface without imparting defects in the cup. In particular, it has been found that if too much of the cup sidewall is exposed above the base, the smashing operation can resulting in microcracking of the sidewalls when the flat top lip is formed. It has been further found that if not enough of the cup sidewall is exposed above the base, inadequate flattening may be achieved and/or the cup can be forced too far into the base and cannot be ejected from the base after the smashing operation.

Double Die Apparatus

Referring now to the figures, FIG. 1A illustrates a schematic view of the deep draw apparatus 100 including a punch 110, a double die (the top (tractrix) die 120, and the bottom die 130), and a blank locator ring 140, where each of the components of the deep draw apparatus 100 may be configured based on the desired specifications of the formed cup 160. In operation, the deep draw apparatus 100 may implement the punch 110 to deform a metal blank 150 through a bore opening of the top die 120 and subsequently through a bore opening of the bottom die 130 to form the cup 160. A blank locator ring 140 may be included to hold the metal blank 150 in place in the top die 120 as the drawing operation begins. As explained above, the drawing operation performed by the deep draw apparatus 100 simultaneously forms the metal blank 150 into the cup shape and thins the sidewalls of the cup as the punch 110 forces the metal blank 150 through both the top die 120 and then the bottom die 130.

The top die 120 has a bore opening through which the metal blank is pressed by the punch. The inner profile of the bore opening shapes the metal blank as it is pushed through. The bore opening of the top die 120 can include a tractrix profile region and a draw line downstream of the tractrix profile region. Downstream is viewed from a top, first end of the top die 120 where the metal blank is initial positioned to a bottom, second end of the top die 120, in the direction in which the punch pushes the metal blank 150 through the apparatus. The tractrix profile region can have a curvature based on a tractrix curve configured using the desired dimensions of the final formed cup 160.

The top die 120 may include at the top, first end, a metal blank receiving area. This receiving area can be horizontally flat region surrounding the bore opening, on which the metal blank 150 can reside. The profile of the bore opening of top die 120 may then slope down from this receiving area based on the tractrix curve to provide the tractrix profile region 122. Alternatively, the tractrix profile region 122 can have the tractrix curvature initiate from a region spaced from the receiving area with an initial curvature from the receiving area defining an initiation region of the top die.

Downstream of the tractrix profile region, the bore opening of the top die has a first draw line 121. The first draw line region represent the narrowest diameter portion of the bore opening of top die 120. As the metal blank is forced by the punch through tractrix profile region 122, the curvature of the cup shape is formed. As the metal blank is further pushed through the first draw line 121, a first ironing or thinning of the sidewall of the forming cup is achieved. A diameter of the first draw line $D_{DL1}$ is determined using the following equation:

$$D_{DL1}=P_D+2(0.85T_{TC}) \quad \text{(Equation 1)},$$

wherein $P_D$ is the diameter of the punch and $T_{TC}$ is the theoretical maximum sidewall thickness of the forming cup as it exits the tractrix profile region. The theoretical maximum sidewall thickness $T_{TC}$ is calculated based on an anticipated maximum thickening of the material by about 22% at the open end of the cup. The drawing process through the tractrix profile will results in a gradient of thickening of the sidewall where at or near a bottom of the cup the sidewall may experience little to no thickening and remain at the thickness of the original metal black $T_{MB}$. The sidewall can thicken in a direction opposite the drawing direction, from a bottom of the cup to the open-end of the forming cup, with a maximum thickening occurring at or near the open-end of the forming cup. The thickening can occur as an increasing gradient in the direction opposite the drawing direction. $T_{TC}$ represents this theoretical maximum sidewall thickness which is at or near the open-end of the forming cup. That is:

$$T_{TC}=1.22*T_{MB} \quad \text{(Equation 2)},$$

where $T_{MB}$ is the thickness of the initial metal blank.

The first draw line 121 further has a first draw line length $L_{DL1}$. The first draw line length is the length along the inner profile of the bore opening having the narrowed first draw line diameter. This length defines, in part, the duration the metal blank is subjected to the ironing operation in the top die. The first draw line length can be about 1.2 times the theoretical thickness of the material of the forming cup as it exits the tractrix region. That is, $$L_{DL1}=1.2*T_{TC} \quad \text{(Equation 3)}$$

where $T_{TC}$ is the theoretical maximum sidewall thickness of the forming cup as it exits the tractrix profile region of the top die.

The combination of the first draw line diameter and the first draw line length corresponds to the amount of thinning or ironing of the sidewalls that is achieved in the top die. It has been advantageously found that a reduction of about 15% to about 33% of the thickening using the first draw line 121 allowed for good processing operation and ultimately in combination with further ironing in the bottom die a final cup having the desired sidewall thickness with a uniform thickness throughout the sidewall.

FIG. 1C provides a schematic illustration of bore opening profiles of a top die 120 and bottom die 130 of an apparatus 100 of the disclosure. As illustrated in FIG. 1C, the profile of the bore opening of the top die 120 may further include a tapered region 124 downstream of the first draw line 121. The tapered region 124 can taper outwardly, away from the opening. For example, the tapered region 124 may have a taper of about 1.5 degrees outward. This taper can facilitate the exiting of the forming cup as it is transitioned from the top die 120 to the bottom die 130. The cup as formed through the top die is also referred to herein as the intermediate cup. The configuration of top die 120 is discussed in detail below with respect to FIGS. 2A-2M.

Figure 1B:
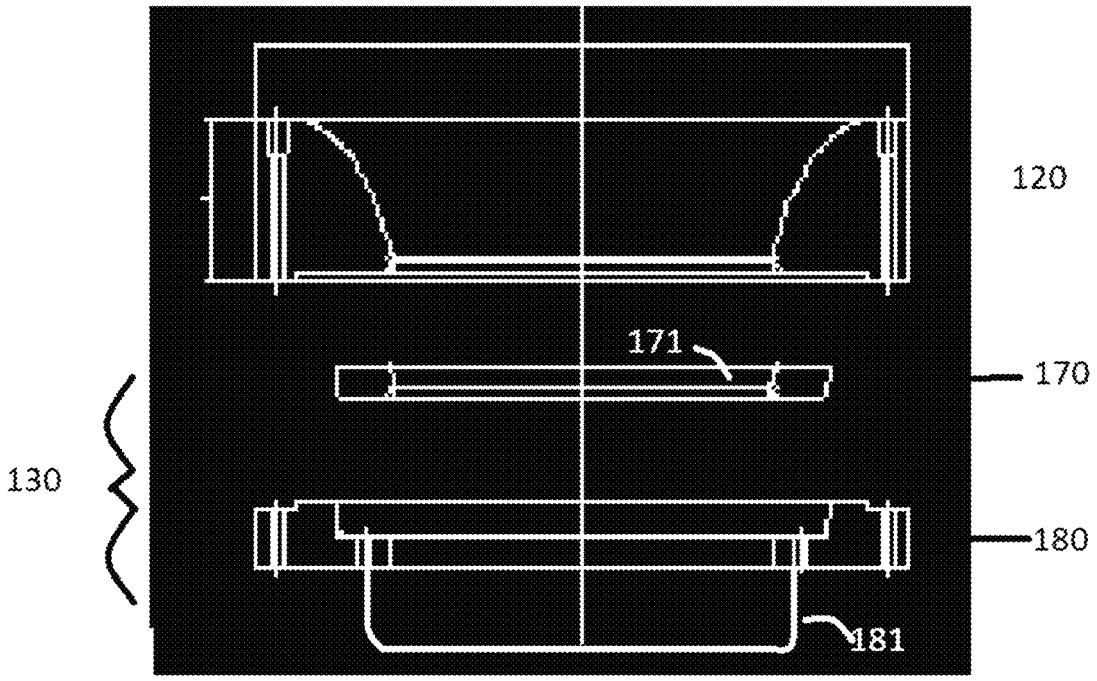
FIG. 1B illustrates a schematic view of the double die of the deep draw apparatus of FIG. 1A.

The bottom die 130 is positioned downstream of the top die 120 and spaced a predetermined distance from the top die. The bottom die 130 has a bore opening 171 that is arranged in line with the bore opening of the top die such that as the punch pushes the intermediate cup out of the top die, the intermediate cup enters the bore opening of the bottom die 130. As illustrated in FIG. 1B, the bottom die 130 may include a draw die 170 and a draw die holder 180. The draw die 170 has the bore opening 171 and is configured to be press fit in the draw die holder 180. The draw die holder 180 is configured to hold the draw die 170 and also includes a bottom surface 181 (i.e., cavity) to receive the formed cup 160.

The bore opening 171 of the draw die 170 has an inner profile. The inner profile includes a second draw line 131. Referring to FIG. 1C, the inner profile can further include one or more tapered regions 132 and 134. For example, the inner profile can include a first tapered region 132 disposed above or upstream of the second draw line 131 and a second tapered region 134 disposed below or downstream of the second draw line 131. Alternatively, only a single tapered region could be included. Either or both of the tapers 132 and 134 can be outward tapers about 1° to about 3° The second tapered region 134, like the tapered region 124 of the top die 120 can facilitate exiting of the formed cup from the bottom die 130. The first tapered region 132 can facilitate entrance of the intermediate cup into the bottom die 130 and can be configured, for example to properly position the intermediate cup as it is received from the top die 120 and prepare it for the second ironing operation in the second draw line 131. The first tapered region 132 can be, for example, an outward taper (away from the opening) of about 3°. The second tapered region 134 can be, for example, an outward taper of about 1.5°.

As with the first draw line 121, the second draw line 131 represents the narrowest diameter portion of the bore opening of the draw die. The second draw line 131 can have a second draw line diameter $D_{DL2}$ calculated as follows:

$$D_{DL2}=P_D+(2T_{FC}) \quad \text{(Equation 4)}$$

where $P_D$ is the punch diameter and $T_{FC}$ is the desired thickness of the final formed cup.

The second draw line 131 further has a second draw line length $L_{DL2}$. The second draw line length is the length along the inner profile of the bore opening of the draw die having the narrowed first draw line diameter. This length defines, in part, the duration the intermediate cup is subjected to the ironing operation in the draw die. The second draw line length can be about 1.4 times the theoretical thickness of the material of the forming cup as it exits the tractrix region. That is, $$L_{DL2}=1.4*T_{IC} \quad \text{(Equation 5)}$$

where $T_{IC}$ is the sidewall thickness of the intermediate cup as it exits the top die.

The $T_{IC}$ is calculated based on an expected rate of ironing occurring at the first draw line 121. For example, a first draw line 121 having an ironing rate of about 15% to about 33% will result in an intermediate cup thickness. The ironing rate can depend at least in part on the material of the blank. $T_{IC}$ can be determined as follows:

$$T_{IC}=I_R*T_{Tc} \quad \text{(Equation 6)}$$

where $I_R$=(1−the ironing rate), and $T_{TC}$ is the theoretical thickness of the sidewall after the tractrix profile region. IR can range for example from about 0.67 to about 0.85 depending on the material of the metal blank being drawn.

The cavity 181 of the bottom die 130 is configured to receive the cup and has a shape substantially matching the shape of the bottom of the cup 160. The diameter of the cavity 181 can correspond to the desired outer diameter of the cup 160, and the depth of the cavity 181 can correspond to the desired height of the cup 160. By correspond, it is intended that the diameter and/or the depth of the cavity can have a substantially similar size to the respective dimension of the cup. The diameter and/or depth of the cavity, for example can be slightly larger than the respective dimension of the cup to allow the cup to be received into the cavity securely, but without further pressure or deformation imparted into the cup from the cavity. The cavity 181 of the bottom die 130 may have a cross section that is wider than it is tall, to provide dimensional stability during the ironing operation A vertical wall of the cavity 181 may also have a 0.5-2 degree taper for proper press fit for dimensional stability during the drawing operation. The components of the bottom die 130 may be made out of any combination of D-2, 4140 or 4340 pre-hardened material, or other similar material.

During the drawing operation both the top die and 120 and the draw die 170 will iron off the sidewall of the metal blank 150 and intermediate cup, respectively as it is being formed into the cup 160. Typically, the top die 120 will iron approximately 15%-33% of the thickening that occurs as the metal blanks is formed through the tractrix profile region of the top die and the draw die 170 will iron the remaining thickness to achieve the desired final cup thickness. The amount of ironing achieved in the top die 120 will depend, at least in part, on the material of the metal blank being drawn. Each die 120 and 170 is configured to iron a specific amount of the material throughout the drawing process. It has been found that if the top die 120 does not result in sufficient ironing, then there is a high likelihood the resulting cup 160 will crack in the sidewall after forming. Further, it has been found that if the top die 120 excessively irons, then there will be similar defects in the sidewall of the cup 160. The draw die diameters and lengths as calculated herein are based on a balancing of the amount of ironing to be done in each die to achieve effective ironing during the drawing process without resulting defects.

It has been further defined that the success of the ironing operation depends, in part, upon a spacing between the top and bottom dies. The top and bottom dies are spaced a predetermined distance. This predetermined distance $H_1$ is measured from a top (upstream most) edge of the first draw die length to the top edge of the second draw die length. It has been found that the predetermined distance $H_1$ should be about 59% to about 78% of the height of the intermediate cup $H_{IC}$. Other suitable values include about 59%, 60%, 61%, 62%, 63%, 64%, 65%, 66%, 67%, 68%, 69%, 70%, 71%, 72%, 73%, 74%, 75%, 76%, 77%, or 78% of the theoretical height of the intermediate cup $H_{IC}$. The theoretical height of the intermediate cup $H_{ic}$ is determined as follows:

$$H_{IC} = \frac{(P_D + C_D)}{(42P_D + 49T_{TC})} \quad \text{(Equation 7)}$$

where $P_D$ is the punch diameter, $C_D$ is the diameter of the metal blank, and $T_{TC}$ is the theoretical maximum thickness of the sidewall of the forming cup as it exits the tractrix profile region of the top die.

It has been found that if predetermined spacing is too small and the first and second draw lines 121 and 131 of the top dies 120 and the draw die 170, respectively, are too close, the side wall of the resulting cup 160 may fail due to tensile yield as a result of too much load during the forming (where the defect is usually near the head-sidewall transition). Further, if the predetermined distance is too large and the first and second draw lines 121 and 131 are spaced too far apart is too far apart, defects may occur in the resulting cup 160 due to a reverse tonnage released during the stroke that will cause shock lines material (and potentially cause splits in the sidewall of the cup 160).

The punch 110 may be a cylinder with a diameter substantially similar to the intended inner diameter of the cup 160. The punch diameter, which corresponds to the inner diameter of the cup, can inform selection of the size of the metal blank. It has been found that a ratio of the punch diameter to the circle diameter of the metal blank ($P_D$:$C_D$) should be about 0.28 to about 0.64. Other suitable values include, about 0.28, 0.3, 0.32, 0.34, 0.36, 0.38, 0.40, 0.42, 0.44, 0.46, 0.48, 0.50, 0.52, 0.54, 0.56, 0.58, 0.6, 0.62, or 0.64. Ranges having end points with any of the foregoing values are also contemplated herein. It has been found that a ratio $P_D$:$C_D$ below 0.28 or above 0.64 resulted in failure of the formed cup. For example, it has been found that below 0.28 the metal blank can slip and/or an uneven cup can form because there is insufficient tension in the head radius, resulting in a misshaped head in the cup. It has been found that above 0.64, cracking or splits can be observed in the sidewalls and/or localized necking can occur. This can result in cracks of head fractures popping the top out of the cup.

The punch 110 may be configured with a flat portion on the bottom of the punch 110. The bottom of the punch 110 may taper up to the cylindrical sidewalls of the punch 110, depending on the desired shape of the cup 160. The punch 110 may also have a hollow pathway from the bottom portion of the punch 110 to one of the sidewalls of the cylinder to aid in removal of the cup 160 from the punch 110 once the drawing operation is complete.

Figure 2A:
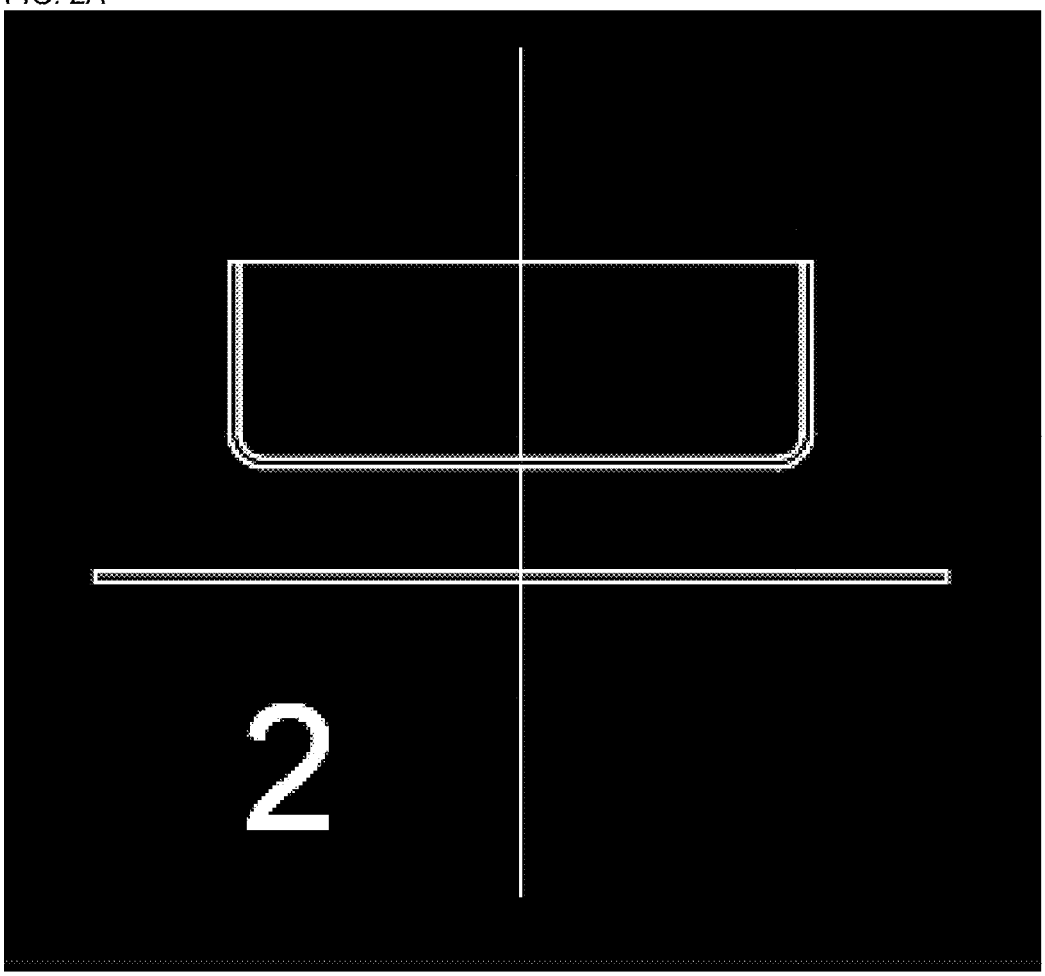
FIGS. 2A-2M illustrate the steps in calculating the tractrix curve for the top die of the deep draw apparatus.
Figure 2B:
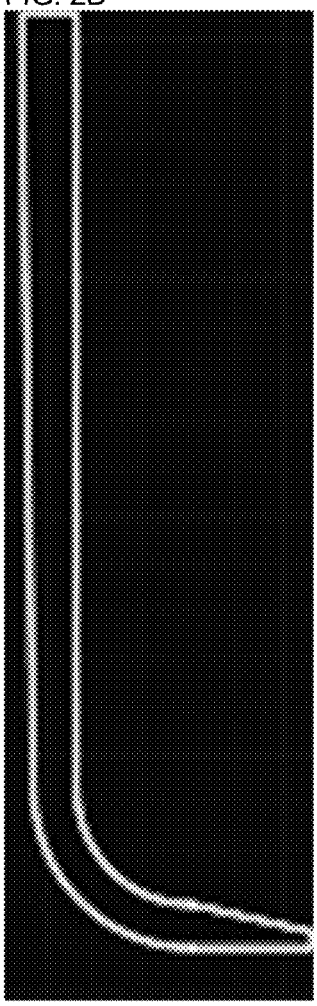

FIGS. 2A-2M illustrate the steps of a method for calculating the tractrix curve for the top die of the deep draw apparatus, such as top die 120 of deep draw apparatus 100 of FIG. 1. The curve development is based on the final desired cup shape, which will have an inner cup diameter $D_{FC}$ and a desired sidewall thickness $T_{FC}$. FIG. 2A illustrates a schematic view of a cup shape which is the intended final shape of a cup produced using the deep draw apparatus. FIG. 2B illustrates a schematic view of a desired wall thickness.

Figure 2C:
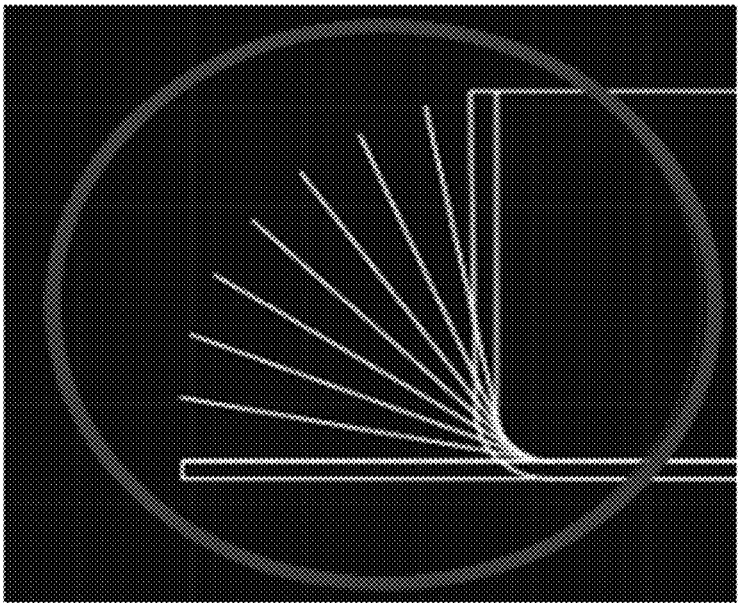
Figure 2D:
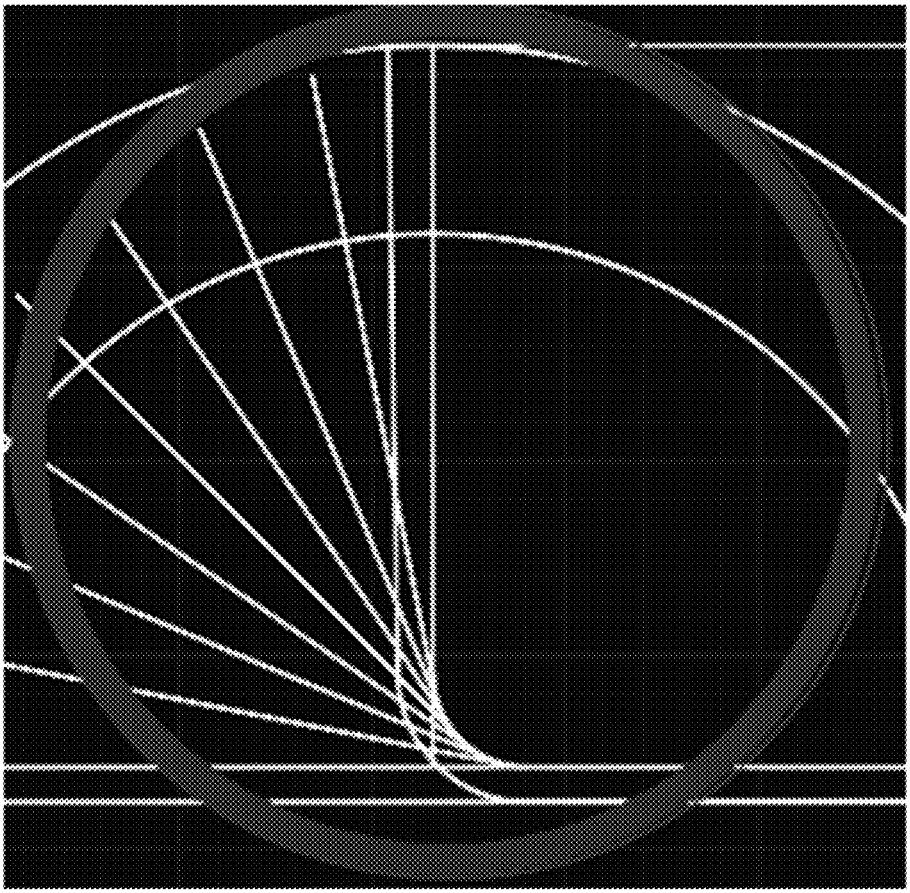
Figure 2E:
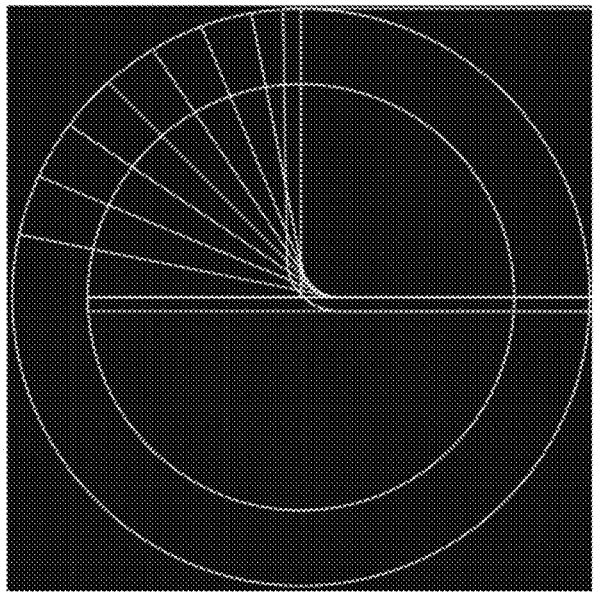

The tractrix curve of the tractrix profile of the top die of the deep draw apparatus is determined using these formed cup parameters. First, a point is selected to project angle lines at 10 degree increments. For example, the point where the flat bottom of the cup begins to taper towards the sidewall may be selected. Next, lines are projected outward at 10 degree increments from a horizontal line extended from the flat bottom of the cup, as illustrated in FIG. 2C. Next, two concentric circles may be drawn from a selected center point, as illustrated in FIGS. 2D and 2E. In an embodiment, the center point may be based on the intersection of a line projected from the flat bottom of the cup to a line projected from an inner sidewall of the cup.

Figure 2F:
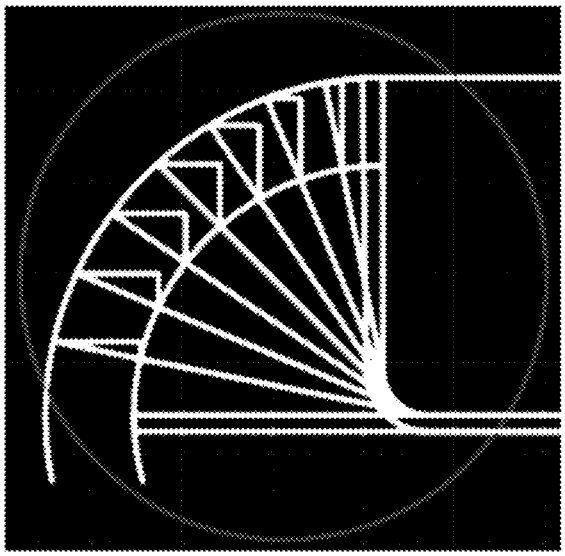

Next, projected horizontal and vertical lines are drawn from points where the projected angle lines intersect with the concentric circles, as illustrated in FIG. 2F. For example, horizontal lines may be projected from where the projected angle line intersects with the outermost circle while vertical lines may be projected from where the projected angle line meets the innermost circle. As illustrated in FIG. 2F, the projected horizontal and vertical lines form right triangles with the corresponding projected angle line, where the horizontal and vertical projection create the right angle of the corresponding right triangle.

Figure 2G:
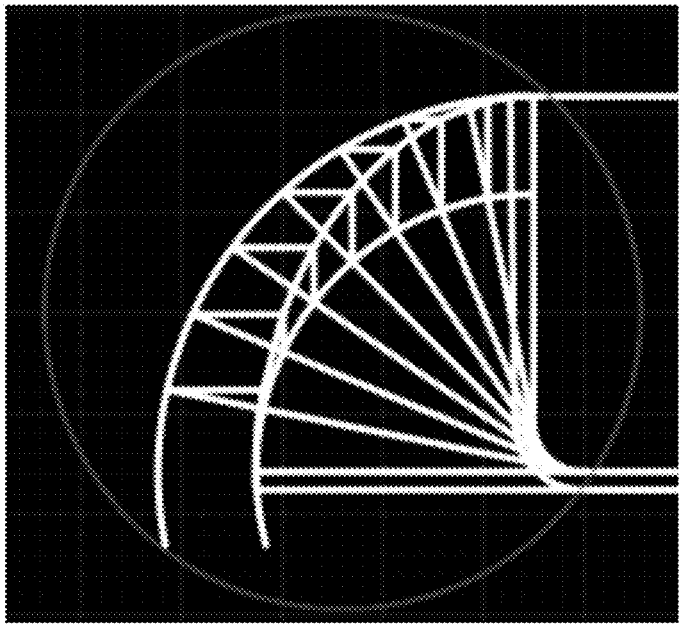

Next, a number of line segments may be drawn connecting the set of points located at the right angle of each right triangle (i.e., where the projected horizontal and vertical lines meet), as illustrated in FIG. 2G. The series of line segments forming a polyline, which may be smoothed using a spline function.

Figure 2H:
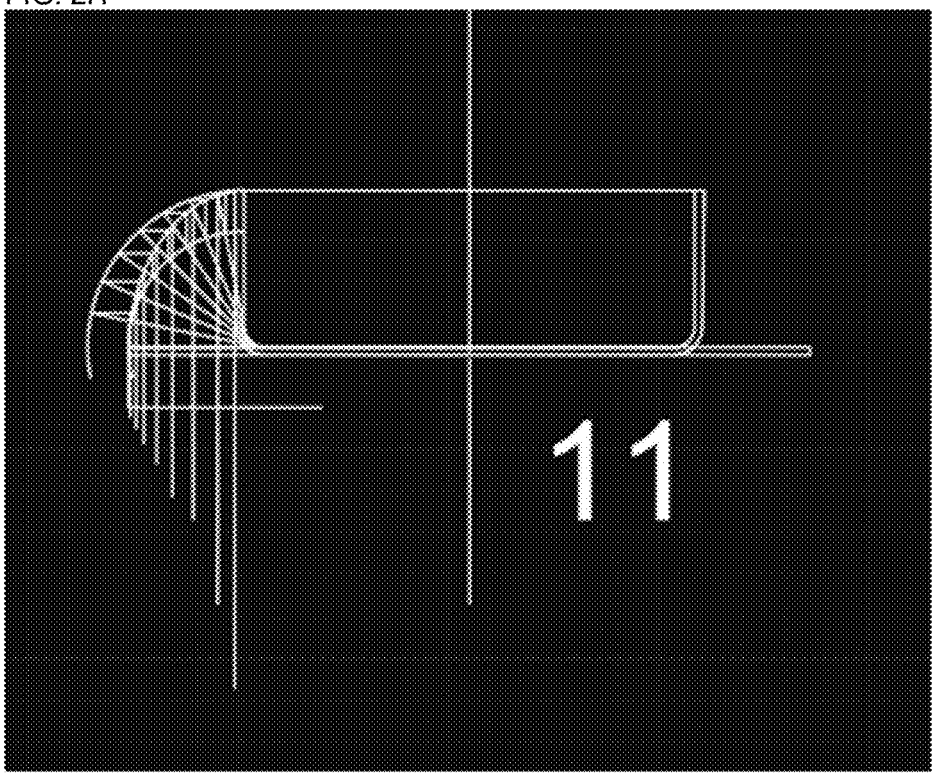
Figure 2I:
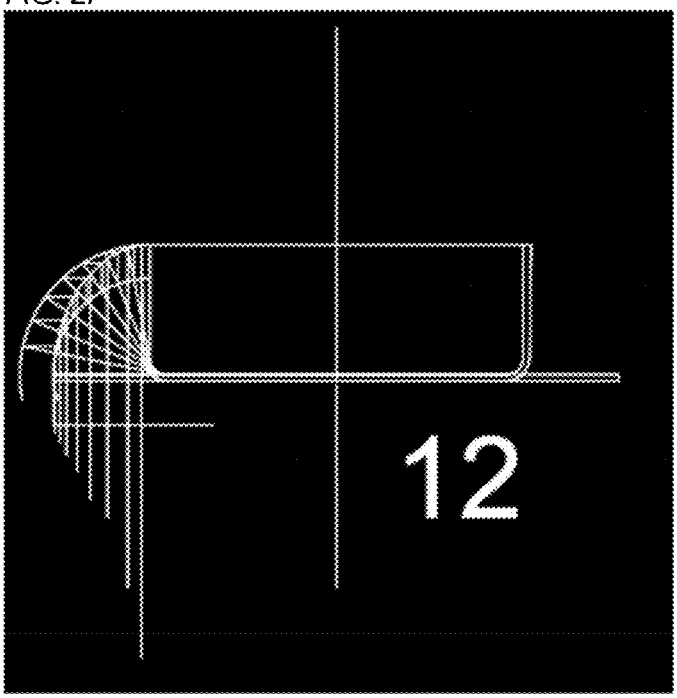

The spline curve is then used to project a number of vertical lines onto a horizontal tractrix line, as illustrated in FIG. 2H. The horizontal tractrix line represents how the final tractrix curve for the top tie will be formulated. The horizontal tractrix line will begin at a point representative of the diameter of the intended metal blank (corresponding with the inner circle of the concentric circles). Vertical lines are projected onto the horizontal tractrix line from the point where the spline curve intersects with the projected angle lines. The horizontal tractrix line is now divided into a number of line segments based on the intersection of the projected vertical lines.

Figure 2J:
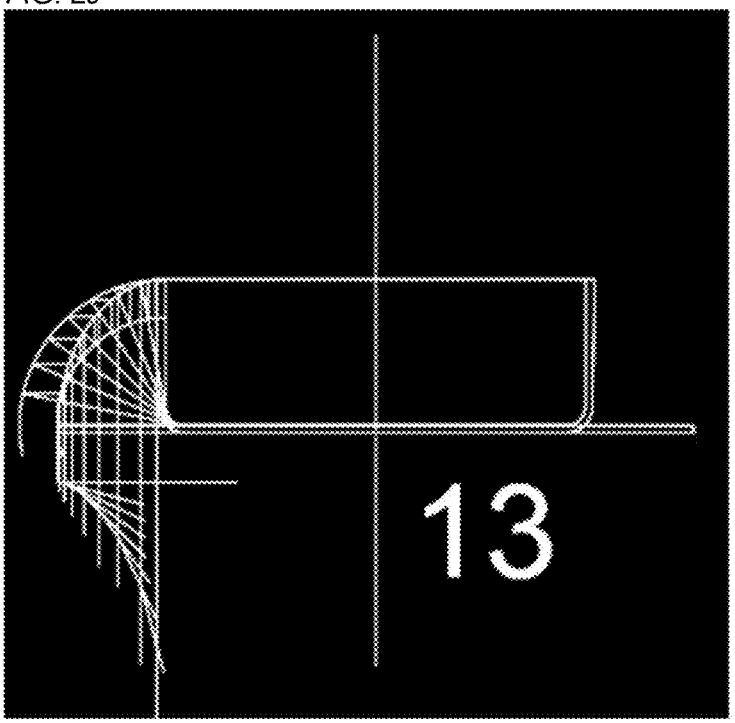
Figure 2K:
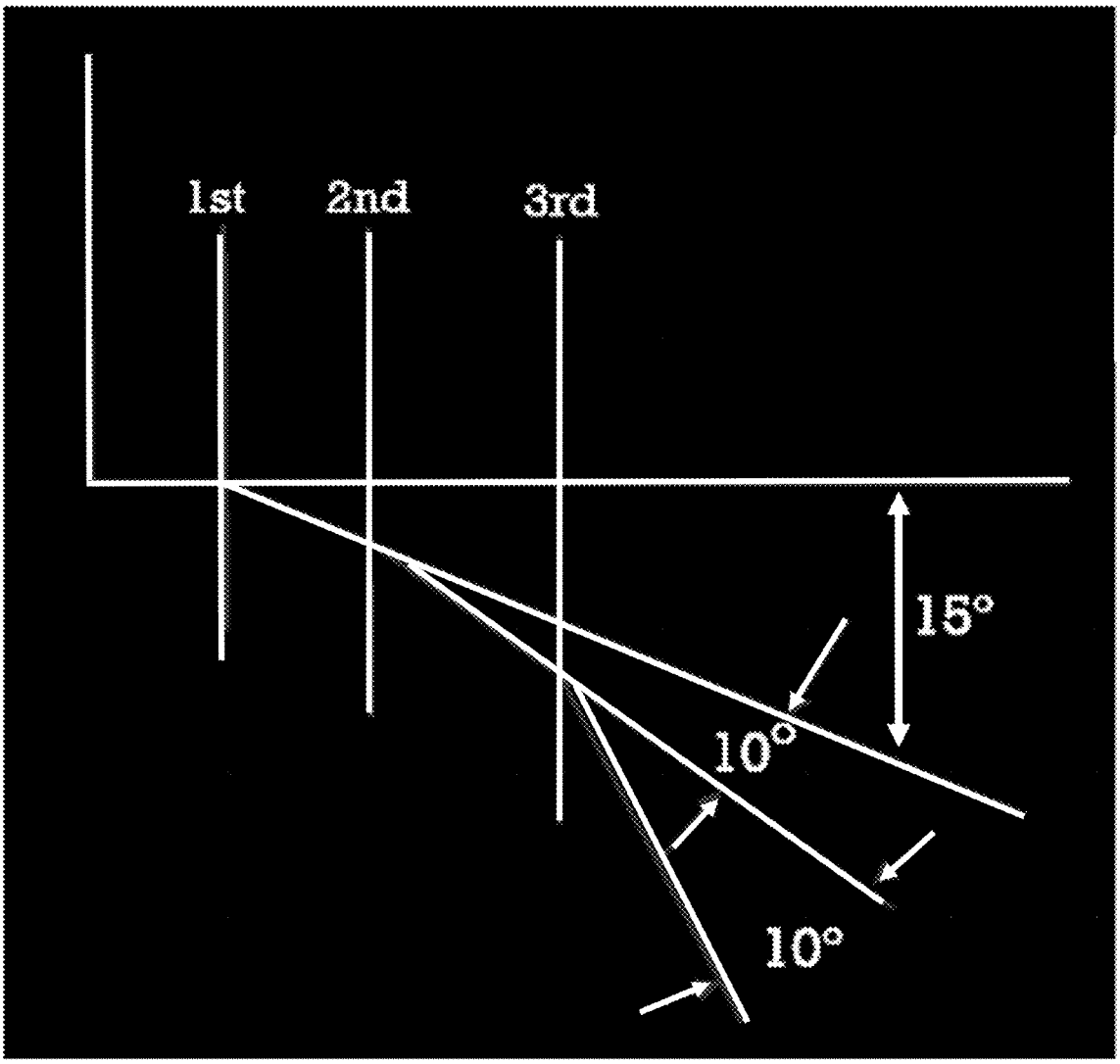

To determine the tractrix curve, a tractrix projection is projected from each point where the horizontal tractrix line intersects with a projected vertical line, as illustrated in FIGS. 2J and 2K. The intersections of the horizontal tractrix line and the projected vertical lines are herein referred to in sequential order as a first intersection, second intersection, etc. (see FIG. 2K). From the starting point of the horizontal tractrix line, a first horizontal line is projected to the first intersection between the horizontal tractrix line and a projected vertical line. This first portion is intended to be flat horizontally in order to allow the top die to receive and hold the metal blank.

Figure 2L:
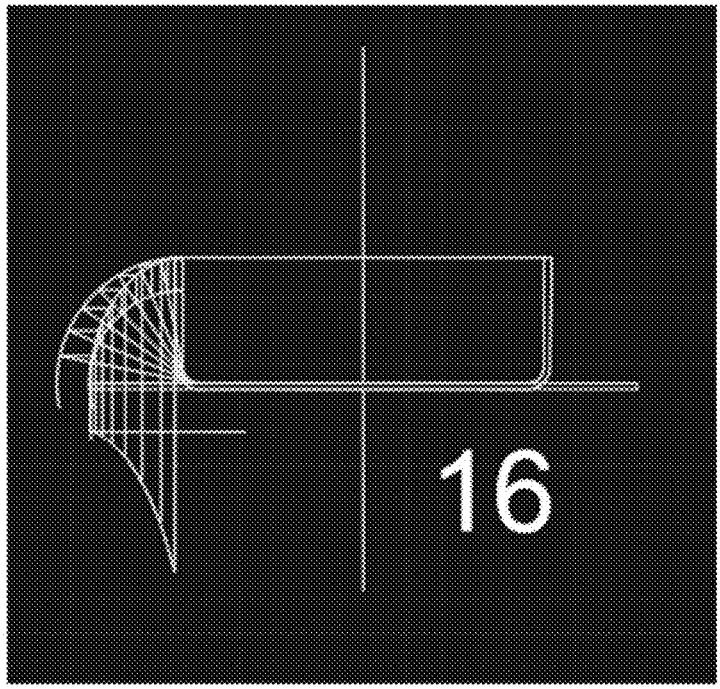

Next, from the first intersection to the second intersection, a line is projected at a negative 15 degree angle from horizontal. From there, lines are projected at negative ten degree increments from the point where the previous projection intersects with a projected vertical line, forming a projected tractrix curve. The projected tractrix curve is then smoothed, as illustrated in FIG. 2L.

Figure 2M:
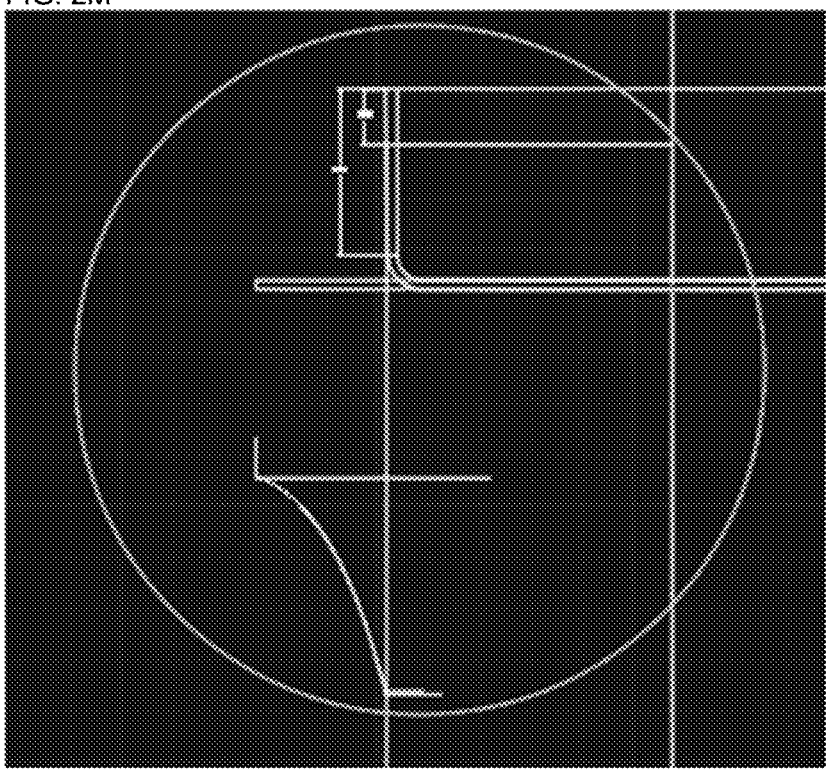

Next, the intended cup design is aligned with the smoothed tractrix curve. A line representing the outer diameter of the cup is then projected down onto the tractrix curve, as illustrated in FIG. 2M. The point in which the projection of the outer wall of the cup intersects with the tractrix curve determines where the draw line for the top die will be located on the tractrix curve. A top die having a bore opening with a tractrix region profile may then be formed based on the calculated tractrix curve.

Smash Operation

Figure 3:
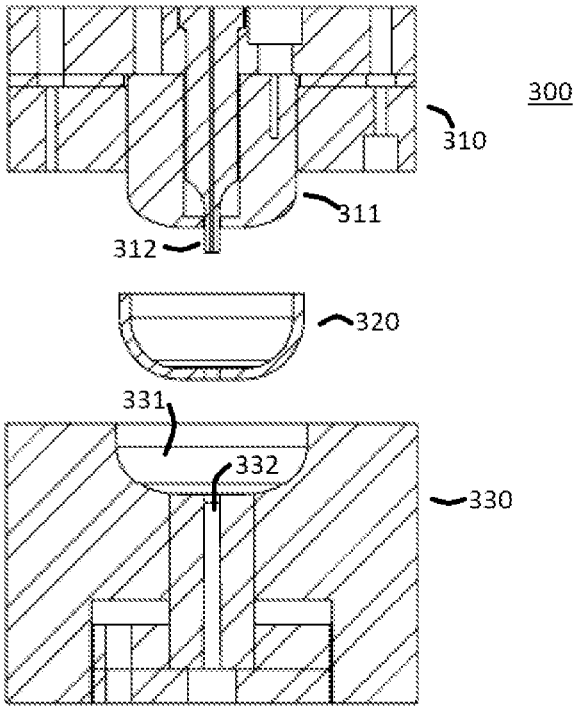
FIG. 3. Illustrates a schematic view of a smash die apparatus.

FIG. 3 illustrates a schematic view of a smashing apparatus 300 including a smash die 310 and a base 330. In use, a deep drawn cup 320 (may be placed in a receiving area 331 of the base 330. For example, the deep drawn cup 320 can be the cup 160 produced by the deep draw apparatus 100 of FIG. 1. The cup 320 is received in the receiving area 331 of the base 330 such that a target portion of the cup 320 is exposed above the base 330. The target portion includes the open-end edge of the cup 320 which is to be flattened. The smash die 310 may then engage with the open-end edge of the cup 320 applying a force against the cup 320 to thereby flatten the open-end edge. The smashing operation performed by the smashing apparatus 300 may prepare the cup 320 for use. For example, a flattened open-end of the cup 320 may be suitable for welding.

The smash die 310 can have a flat bottom portion, which is larger than the cup, such that the smash die 310 will strike the cup 320 evenly when the smashing operation is performed. In some embodiments, the smash die 310 may include a punch portion 311 intended to help provide stability to the walls of the cup 320 as the smashing operation is performed. Further, in some embodiments, the punch portion 311 may further include a piercing tip 312 configured to puncture the bottom of the cup 320 if such an opening is desired. For example, if the cup is used as a portion of a pressure vessel, the puncture can be a location for receiving a pressure regulator.

In an example embodiment, the smash die may meet the base 330 with approximately 71 tons of force. For example, if the material is protruding by 1.38 inches, the smashing operation will exert roughly 108,000 pounds/inch$^2$ of force.

The base 330 includes a receiving area 331 configured based on the desired specification of the cup. The receiving area 331 may have a taper of 1 degree outward such that the cup 320 may be removed from the base 330 after the smashing operation is complete. In an embodiment, the cup 320 will protrude from the base 330 by a measurement related to the thickness ($T_{FC}$) of the cup 320. For example, the cup may protrude between 0-24% of $T_{FC}$. For example, the cup may product 17.26% of $T_{FC}$. If the cup 320 protrudes from the base 330 by a measurement outside of the appropriate range, the smash operation may not work correctly and cause damage to the cup. For example, protrusion at an amount above 24% can result in the smashing operation causing nonuniformity in the sidewall thickness and/or inducing defects in the material of the cup.

The base may also be configured with a hollow channel 332 for air that will allow the smashed cup 320 to be removed from the base 320. In some embodiments, the hollow channel 332 may also be configured to receive a portion of the cup 320 and the piercing tip 312 of the smash die 310.

Figure 4:
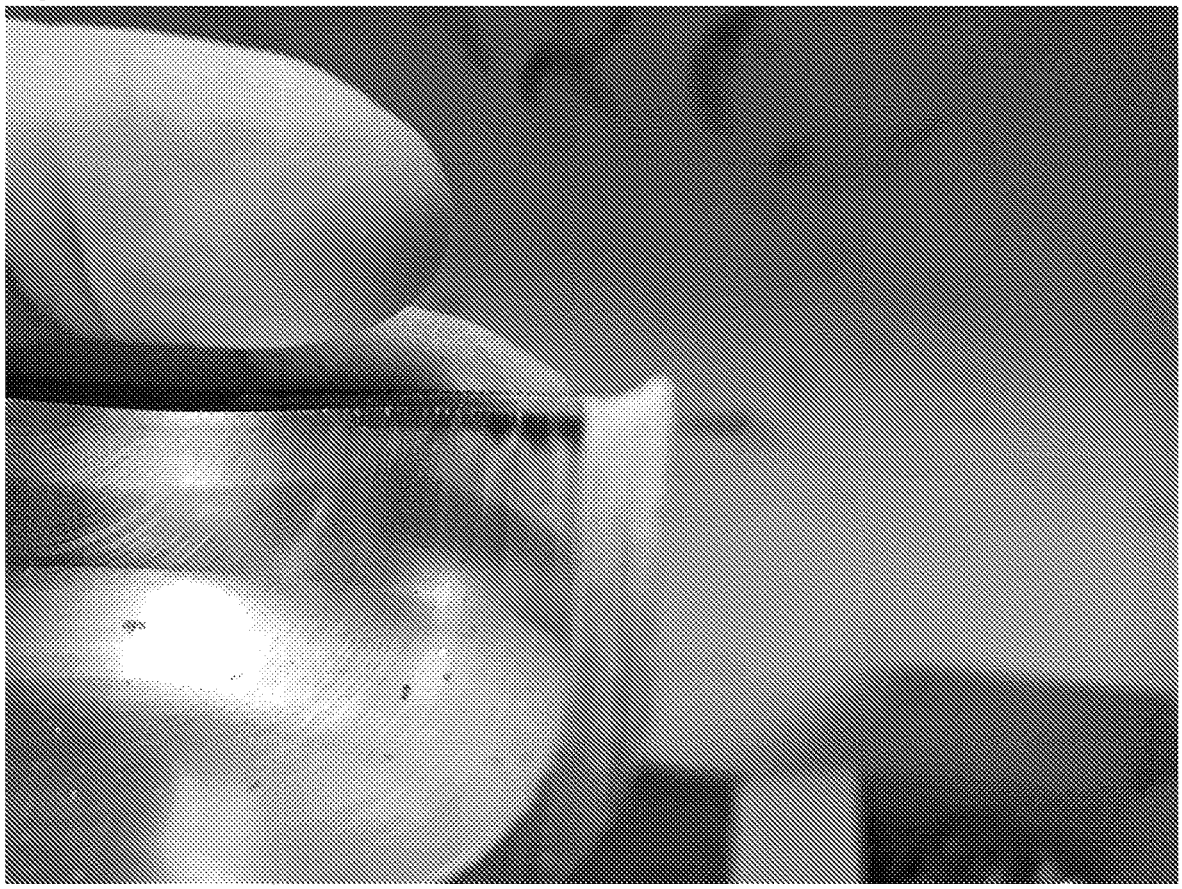
FIG. 4 illustrates an example cross section of a drawn cup prior to smashing.

FIG. 4 illustrates an example cross-section of a deep drawn cup prior to smashing. The cup of FIG. 4 has a sharply tapered edge as a resulting of the drawing operation. While the rest of the cup walls have a uniform thickness, the open-end is tapered to a point. While the cup is not defective, the tapered open-end may not be suitable for some uses, such as welding.

Figure 5:
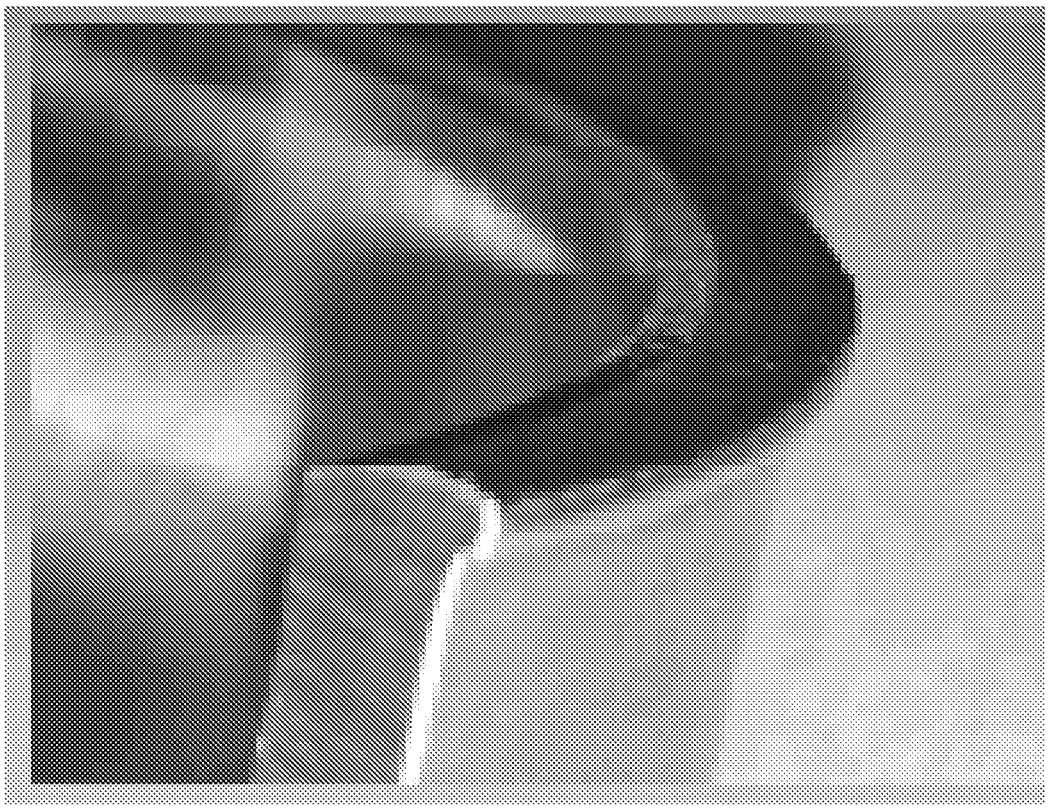
FIG. 5 illustrates an example cup after the smashing operation.
Figure 6:
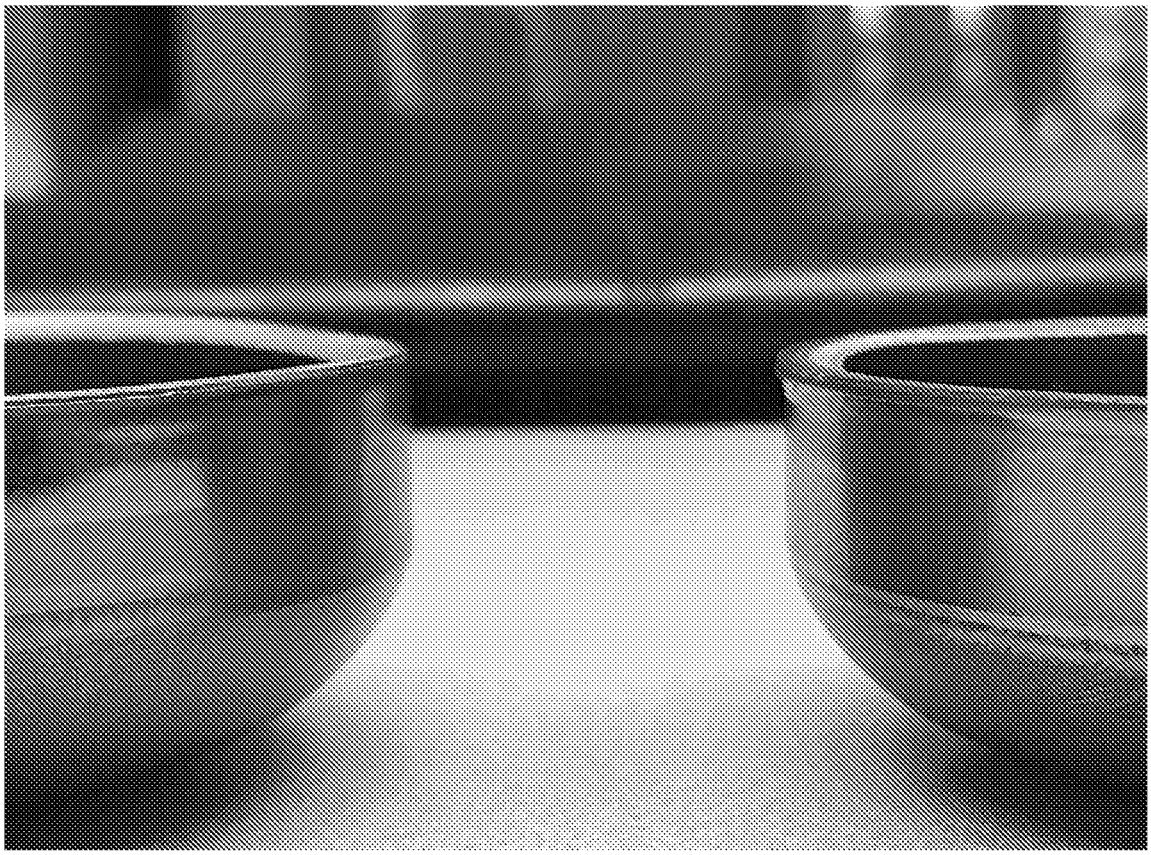
FIG. 6 illustrates an example side-by-side view of a cup that has been smashed and a cup that has not been smashed.

FIG. 5 illustrates an example cross-section of a smashed cup. In FIG. 5, the open-end of the cup is flattened when compared to the pre-smashed cup of FIG. 4. The smashed cup of FIG. 5 is suitable for welding and other uses. FIG. 6 illustrates a side-by-side comparison of a pre-smashed cup (left) and a smashed cup (right).

EXAMPLES

A double die as disclosed herein was used to manufacture a deep drawn cup having a target cup diameter $D_{FC}$ of 2.402 in and a target sidewall thickness of 0.157 in.

Based on the target cup diameter of 2.402 in, a punch diameter of $P_D$ of 2.402 in was selected. A metal blank having a thickness of 0.177 inches and a diameter $C_D$ of 4.440 in was used. This resulted in a $P_D$:$C_D$ of 0.54. Three grades of high strength low alloy metals were tested—Grade 85K, 80K, and 100K, where the values represent the tensile strength.

The double die had a top die having a tractrix profile region starting from a top edge of the top die. The tractrix profile was determined as described herein and shown in FIGS. 2A-2M. Downstream of the tractrix profile region the top die had a first draw line having a first draw line diameter of 2.766 in. This was calculated using equation 1 based on the theoretical thickening of the sidewall of 22% (equation 2). Thus, in this example $T_{TC}$ was 0.215 inches and $P_D$ was 2.402 (the target inner diameter of the formed cup). The first draw line length ($L_{DL1}$) was calculated using equation 3 and determined to be 0.258 in.

The second draw line diameter $D_{DL2}$ was calculated to be 2.716 in using equation 4 and the target cup wall thickness of 0.157 inch. The second draw line length $L_{DL2}$ was calculated using equation 5. The thickness of the intermediate cup $T_{IC}$ was calculated to be 0.182 based on a projected ironing form the top die at a rate of 15% (0.215 in*0.85=0.182 in).

The predetermined space was set a 66% of the intermediate cup height $H_{IC}$ and determined to be 0.832 in. The intermediate cup height was calculated using equation 7 and determined to be 1.26 in.

Cups were formed through the double die by applying a tonnage of 39 tons±5 tons depending on the tensile strength and gauge thickness variations.

All resulting cups were found to be substantially free of defects and achieved the target dimensions.

Subsequent formation of the cups into pressure vessels was performed and none of the pressure vessels failed after pressurization. A smashing operation as described herein was used to prepare the cups for welding for forming the pressure vessels.

What is claimed:

1. A method of deep drawing a metal blank into a deep drawn cup having a cup wall thickness TFC, a cup inner diameter DFC and a cup height HFC cup, comprising:

applying pressure to a metal blank using a punch to deform the metal blank drawing it into a bore opening of a top die, the bore opening having a tractrix profile region and a first draw line downstream of the tractrix profile region as viewed from a first end of the opening to a downstream second end of the opening, wherein the tractrix profile is configured based on the outer diameter of the metal blank and outer diameter of the to be formed cup, wherein upon drawing the metal blank through the bore opening of the top die the metal blank is drawn into a desired cup shape and a sidewall thickness is ironed to a first reduced thickness, and;

applying further pressure to the metal blank with the punch to further deform the metal blank drawing it into a bore opening of a bottom die positioned immediately downstream of the top die and spaced a predetermined distance from the top die, wherein the bore opening of the bottom die has a second draw line, a second draw line diameter DDL2 being smaller than a first draw line diameter Di, thereby further ironing the sidewall thickness to a second side wall thickness, wherein:

a ratio of a diameter of the punch to a diameter of the metal blank (PD:CD) is about 0.28 to about 0.64, the predetermined distance is measured as a distance between an upstream-most edge of a length of the first draw line and an upstream-most edge of a length of the second draw line, and the predetermined distance is about 59% to about 78% of a theoretical height of the intermediate cup H1c of the deep drawn cup.

2. The method of claim 1, further comprising flattening a top edge of the deep drawn cup by placing the deep drawn cup in a base of a smashing apparatus such that a protrusion ranging in length from 0 to 24% of the thickness of a sidewall of the deep drawn cup TFc remains exposed above the base of the smashing apparatus and applying pressure to the top edge using a substantially planar smashing die.

3. The method of claim 1, wherein the punch is operated to apply a pressure of about 71 tons to the metal blank.

4. The method of claim 1, wherein the metal blank is at substantially room temperature during drawing.

5. The method of claim 1, wherein the metal blank comprises a carbon steel having a carbon content of 0.8 to about 0.15.

6. The method of claim 1, wherein a diameter of the punch is substantially same as the cup inner diameter $D_{FC}$.

7. The method of claim 1, wherein the first draw line diameter $D_{DL1}$ is determined by $D_{DL1}=P_D+2(0.85T_{TC})$, where $P_D$ is a diameter of the punch and $T_{TC}$ is a theoretical maximum thickness of a sidewall of a forming cup exiting the tractrix profile region.

8. The method of claim 1, wherein the first draw line length $L_{DL1}$ is determined by $L_{DL1}=1.2*T_{TC}$, where $T_{TC}$ is a theoretical maximum thickness of a sidewall of a forming cup exiting the tractrix profile region.

9. The method of claim 7, wherein $T_{TC}$ is 1.22 times a thickness of the metal blank.

10. The method of claim 1, wherein the second draw line diameter $D_{DL2}$ is determined by $D_{DL2}=P_D+(2T_{FC})$, where $P_D$ is a diameter of the punch and $T_{FC}$ is the sidewall thickness of the cup.

11. The method of claim 1, wherein the second draw line length $L_{DL2}$ is determined by $L_{DL2}=1.4*T_{IC}$, where $T_{IC}$ is a thickness of the intermediate cup.

12. The method of claim 11, wherein $T_{IC}$ is 85% of a theoretical maximum thickness of a sidewall of a forming cup exiting the tractrix profile region $T_{TC}$.

13. The method of claim 12, wherein $T_{TC}$ is 1.22 times a thickness of the metal blank.

14. The method of claim 1, wherein the first draw line irons a thickness of the forming cup about 15% to about 33%.

15. The method of claim 1, further holding the metal blank with a blank locator ring when the punch engages with the metal blank.

16. A method of forming an apparatus for deep drawing a cup, the apparatus comprising a top die spaced a predetermined distance from a bottom die, the method comprising:

preparing a top die having a bore opening having a tractrix profile region and a first draw line, wherein:

the tractrix profile is determined by:

determining points along a tractrix curve by articulating a segment having the target cup height in about 10° increments from a vertical segment representing the target cup height to a horizontal segment perpendicular to the vertical segment, and projecting the points along the curve to a space below the curve at equivalent distances to develop an inverted tractrix curve defining the tractrix profile, the first draw line is determined by:

defining a diameter of the first draw line $D_{DL1}$ such that $D_{DL1}=P_D+2(0.85T_{TC})$, where $P_D$ is a diameter of the punch and $T_{TC}$ is a theoretical maximum thickness of a sidewall of a forming cup exiting the tractrix profile region, defining a length of the first draw line $L_{DL1}$ such that $L_{DL1}=1.2*T_{TC}$, where $T_{TC}$ is a theoretical maximum thickness of a sidewall of a forming cup exiting the tractrix profile region, preparing the bottom die having a draw die having a second draw line, the second draw line being determined by:

defining a diameter of the second draw line $D_{DL2}$ such that $D_{DL2}=P_D+(2T_{FC})$, where $P_D$ is a diameter of the punch and $T_{FC}$ is the sidewall thickness of the cup, and defining a length of the second draw line $L_{DL2}$ such that $L_{DL2}=1.4*T_{IC}$, where $T_{IC}$ is a thickness of an intermediate cup exiting the top die;

selecting the predetermined distance between the top and bottom die as measured between an upstream most edge of the first draw line length to an upstream most edge of the second draw line length to be 59% to about 78% of a theoretical height of the intermediate cup.

17. The method of claim 16, further comprising preparing a punch, wherein a diameter of the punch is substantially same as an inner diameter $D_{FC}$ of the cup to be formed.

18. The method of claim 16, wherein $T_{TC}$ is 1.22 times a thickness of the metal blank.

* * * * *